United States Patent [19]

Furukawa

[11] Patent Number: 4,602,790

[45] Date of Patent: Jul. 29, 1986

[54] TOY ARCADE TARGET GAME

[75] Inventor: Masami Furukawa, Tokyo, Japan

[73] Assignee: Tomy Kogyo, Co. Inc., Tokyo, Japan

[21] Appl. No.: 726,025

[22] Filed: Apr. 23, 1985

[30] Foreign Application Priority Data

Apr. 27, 1984 [JP] Japan ..... 59-61477[U]

[51] Int. Cl.[4] ..... A63F 9/08

[52] U.S. Cl. ..... 273/316

[58] Field of Search ..... 273/1 GC, 1 GE, 313, 273/316

[56] References Cited

U.S. PATENT DOCUMENTS

| | | | |
|---|---|---|---|
| 2,531,608 | 11/1950 | Bula | 273/316 |
| 3,635,477 | 1/1972 | Ochi | 273/316 |
| 4,241,925 | 12/1980 | Watanabe | 273/316 |
| 4,296,931 | 10/1981 | Yokoi | 273/316 |

FOREIGN PATENT DOCUMENTS

| | | | |
|---|---|---|---|
| 607795 | 9/1948 | United Kingdom | 273/1 GC |
| 2115705 | 9/1983 | United Kingdom | 273/316 |

*Primary Examiner*—Anton O. Oechsle

*Attorney, Agent, or Firm*—Herb Boswell

[57] ABSTRACT

A game of skill has a housing with a hollow drum mounted inside the housing. A transparent indicia strip is mounted on the drum. A spring is positioned in front of the drum, and a light is located within the interior of the drum such that the light illuminates the indicia strip to cast an image of the strip on the screen. The light is connected to a handle which is controlled by the operator, whereby the image of the indicia is moved across the screen depending upon the operator movement of the handle. The handle further includes a fire button connected to a control mechanism which senses the concurrent depression of the fire button and the location of an image of the indicia on the screen in a target area outlined on the screen.

19 Claims, 19 Drawing Figures

Fig. 13
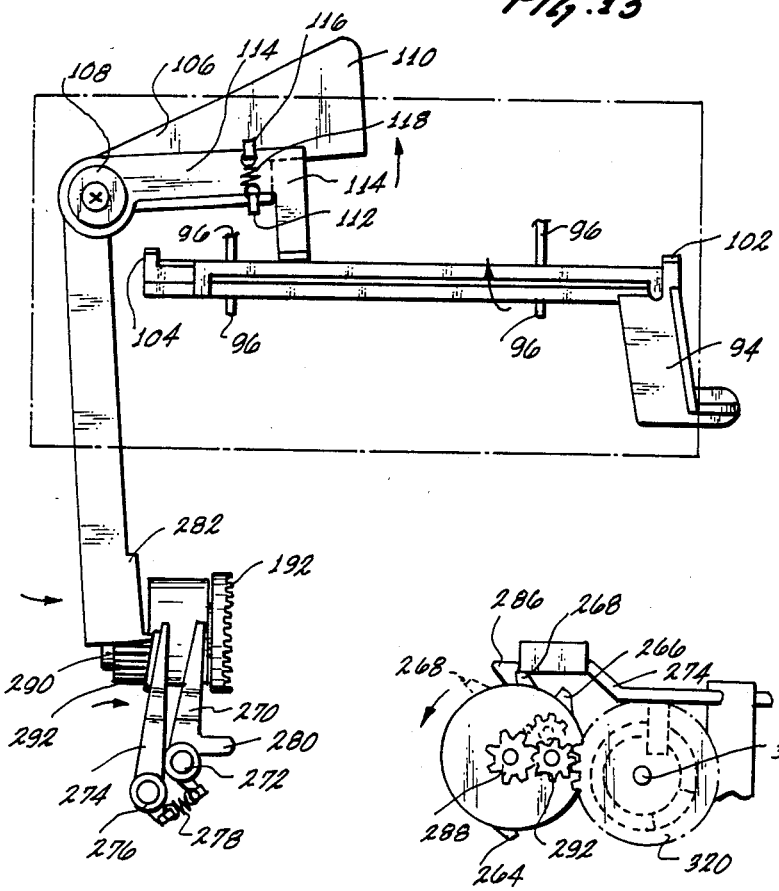
Fig. 14
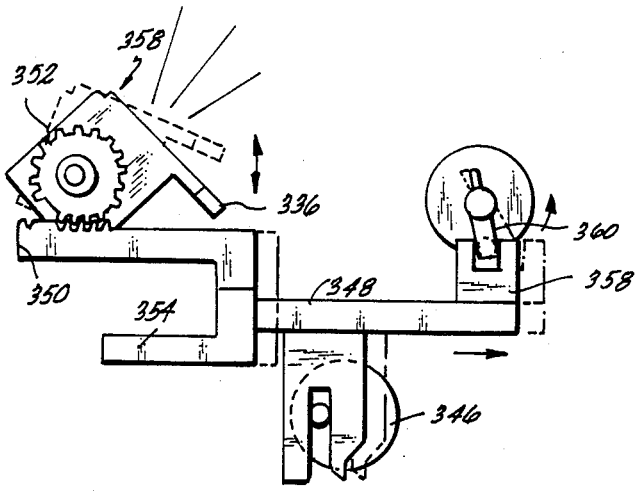
Fig. 15

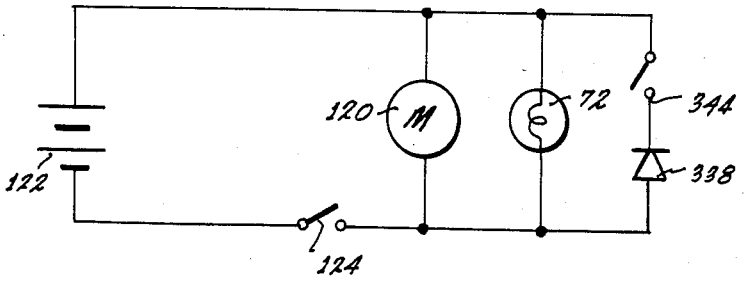
Fig. 18
Fig. 19
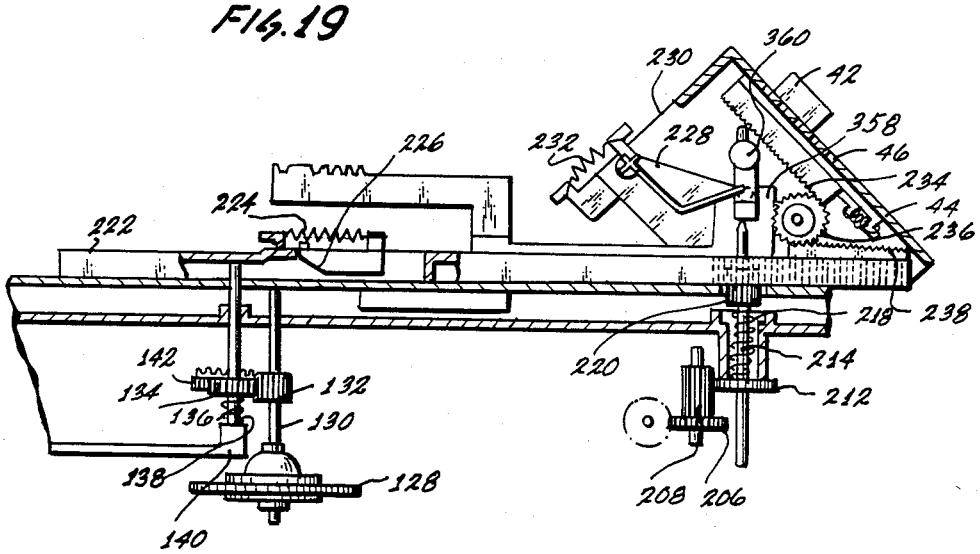

TOY ARCADE TARGET GAME

BACKGROUND OF THE INVENTION

This invention is directed to a toy game of skill which utilizes a projection system to project a movable image onto a screen which includes a target area. The toy includes a control sensing mechanism which senses the concurrent positioning of the image within the screen target area with simultaneous activation of a trigger mechanism.

A variety of toy games of skill are known. These have utilized a variety of mechanisms in order to create a situation for the user of the toy which requires manual dexterity, eye/hand coordination, and judgment on the part of the user of the toy. Action within a game of skill can be achieved utilizing either mechanical or electronic components.

In games of skill which utilize mechanical components, action within the game is normally achieved utilizing rotating disks, film strips, drums, or the like. In a typical game of this type an object which is under the control of the operator is positioned above the drum, film strip, or the like, and a pathway which the object must traverse is printed on the drum, film strip, or the like. Typically, these types of games have not utilized light projection systems because of the sophistication and cost involved. Games which do utilize light projection systems to create a moving image, because of the complexity and cost, have been limited to arcade type situations and not to personal games which are portable and are for individual use.

BRIEF DESCRIPTION OF THE INVENTION

Because of the fads and mood changes of the public, there is an ever present need for new and improved games of skill. It is a broad object of this invention, therefore, to provide for a new game of skill. It is a further object of this invention to provide for a game of skill which utilizes a simple mechanical sensing device to coordinate operator interaction of the game with the mechanical action of the game. It is a further object of this invention to provide in the illustrative embodiment thereof a light projection system capable of projecting a moving image of an object wherein the light projection system is of simple, yet effective, construction and operation. It is an additional object of this invention to provide for a toy game of skill which, because of its construction and engineering principles embodied therein, is capable of a long useful lifetime, and is economically available to the consuming public.

These and other objects as will be evident from the remainder of this specification are achieved in a toy which comprises: a housing; a hollow drum means rotatably mounted on said housing; driving means located on said housing in operative association with said drum means, said driving means rotating said drum means on said housing; at least a portion of the surface of said drum means transparent to the passage of light through said surface of said drum means; at least one indicia means located on said transparent portion of said surface of said drum means; screen means located on said housing in association with said drum means; at least one contact means located on said drum means, said contact means located in association with said indicia means; a moving means located on said housing in operative association with said drum means, a first portion of said moving means located within the interior of said drum means, a second portion of said moving means located in association with said contact means so as to be able to interact with said contact means, a third portion of said moving means located on said housing in a position so as to be capable of being acted on by an operator of said toy; said first and said second portions of said moving means operatively connected to said third portions of said moving means so as to move on said housing in response to action on said third portion of said moving means by an operator of said toy; a light source means positioned on said first portion of said moving means within the interior of said drum means, said light source means moving in conjunction with movement of said first portion of said moving means, said light source means emitting light within the interior of said drum means, said light passing through said transparent portions of said surface of said drum means and projecting an image of said indicia means on said screen means, said image of said indicia means moving on said screen in response to both rotation of said drum means on said housing and to movement of said moving means; output means located on said housing in operative association with said second portion of said moving means, said output means for indicating concurrent interaction of said contact means with said second portion of said moving means and projection of said image of said indicia means on said screen.

Further, these objects are achieved in a toy which comprises: a housing; an event indicator means, said event indicator means for indicating an event to a user of said toy; a user activation means located on said housing, at least a portion of said user activation means located on said housing in a position so as to be activated on by a user of said toy; a first linking means movably mounted on said housing, said first linking means operatively associated with said user activation means, said first linking means moving between a first position and a second position and back to said first position in response to activation of said user activation means; a second linking means movably mounted on said housing, said second linking means operatively associated with said event indicator means, said second linking means movable between a first position and a second position, said second linking means moving from said first position to said second position in response to indication of said event, said second linking means moving from said second position back to said first position in response to said event no longer being indicated; a control means located on said housing, said control means including a first interaction means and a second interaction means, said control means moving on said housing from an initial position to an intermediate position and back to said initial position, said first linking means operatively associated with said first interaction means whereby when said first linking means is in its respective first position said control means is held in its initial position and when said first linking means moves from its first position to its second position said control means moves from its initial position to at least its intermediate position; said second linking means operatively associated with said second interaction means whereby if said second linking means is in its second position when said control means moves from its initial position to its intermediate position said second linking means interacts with said second interaction means to temporarily hold said control means in its intermediate position and when said second linking means is in its first position when said control means moves from its first position to its intermediate position said second linking means does not interact with said second interaction means and said control means moves from its intermediate position to its first position.

In the illustrative embodiment of the invention, the movement of the indicia on the screen in one direction will be in response to rotation of the drum means, and movement of the indicia on the screen in a further direction will be in response to movement imparted to the light source means by the operator of the toy. Further, in the illustrative embodiment, the moving means will include a first and second lever means which are attached to further portions of the moving means so as to be simultaneously activated by the operator of the toy. However, the first and second lever means each will have a mechanical advantage different from the other whereby the magnitude of movement of the light source means attached to the first lever means will be different than the magnitude of movement of the second lever means.

In the illustrative embodiment a control mechanism is utilized which includes a control drum having at least first and second detents thereon. A first control arm is positioned over the control drum so as to interact with the first detent, and a second control arm is positioned over the control drum to interact with the second detent. The first control arm is moved in direct response to user input to the toy, and the second control arm is moved in response to interaction of a target mechanism. The control drum can be further associated with a delay mechanism requiring a timing response between input by the user of the toy and activation of the target mechanism.

BRIEF DESCRIPTION OF THE DRAWINGS

This invention will be better understood when taken in conjunction with the drawings wherein:

FIG. 13 is a plan view of certain components generally found along the left hand edge and below the drum as seen in FIG. 2;

FIG. 14 is an elevational view about the line 14—14 of FIG. 3;

FIG. 15 is an elevational view about the line 15—15 of FIG. 3;

FIG. 18 is an electrical schematic of the invention; and

FIG. 19 is a side elevational view in partical section about the line 19—19 of FIG. 2.

This invention utilizes certain principles and/or concepts as are set forth in the claims appended to this specification. Those skilled in the toy arts will realize that these principles and/or concepts are capable of being expressed in a variety of embodiments which may differ from the exact embodiment utilized herein for illustrative purposes. For this reason, this invention is not to be construed as being limited solely to the illustrative embodiment, but should only be construed in view of the claims.

DETAILED DESCRIPTION OF THE INVENTION

Figure 1:
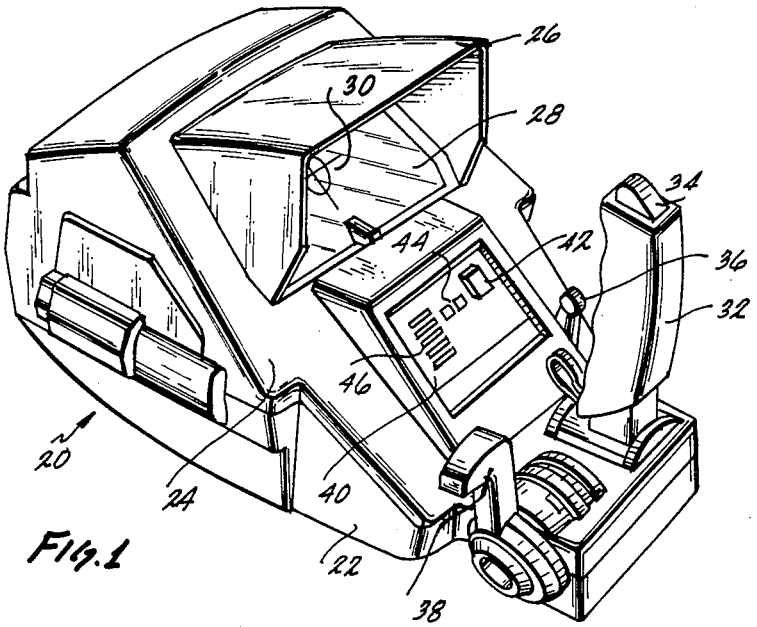
FIG. 1 is an isometric view of the outside appearance of a toy embodying the principles of this invention.

In FIG. 1 there is shown a toy 20 which is in the form of a game of skill. It includes several external components. These include a bottom housing component 22 and a top housing component 24 which are joined together. A hood 26 attaches to the top housing component 24 and shields a screen 28. In the center of the screen 28 is a target area 30. As hereinafter explained, the screen 28 and the target area 30 are back illuminated. The hood 26 serves to shield the screen 28 from overpowering overhead ambient light allowing the target area 30 and other projections on the screen 28 to be viewable even in direct sunlight.

On the front of the toy 20 is a handle 32. On top of the handle 32 is a fire button 34. To the right of the handle 32 is a off/on control handle 36. And to the left of the handle 32 is a speed shifting handle 38. The off/on handle 36 controls the activation and deactivation of the toy 20. The speed shift handle 38 controls the speed of action of the toy 20.

The handle 32 is free to pivot or tilt back and forth from the left to the right in order to control the image of certain indicia projected onto the screen 28 as hereinafter explained. The fire button 34 is depressed into the handle 32 in order to simulate the firing of a missile or other attack like object toward the projected indicia.

Also viewable on the outside of the toy 20 is a panel 40 which includes reset button 42, hit counters collectively identified by the numeral 44, and an elapsed playing time indicator shown by the numeral 46.

Use of the toy is as follows. The reset button 42 is depressed to reset the hit counter 44 to zero and reset the elapsed playing time indicator 46. The off/on switch 36 is then moved forward toward the screen 28 to the on position. This completes an electrical circuit as hereinafter explained. Completion of the electrical circuit results in, among other things, the projection of an image onto the screen 28. The speed shifting handle 38 can then be moved from a neutral to one of four forward speeds, 1, 2, 3, or 4. The greater the number, the faster the action of the toy game 20. Upon engagement of the speed shifting handle from neutral to one of the forward speed positions, a series of images of objects continually move from top to bottom across the screen 28. The images can be made to move left and right, that is along the horizontal by tilting the handle 32 to the left and right respectively.

Included in the image which is projected onto the screen 28 and a plurality of indicia which represent targets. When one of these targets is located within the target area 30, the operator of the toy depresses the fire button 34 and, if the depression of the first button 34 is coordinated with the positioning of the target image within the target area 30, a hit is scored and is registered on the hit counters 44. The elapsed playing time is continually monitored on the elapsed playing time indicator 46. When this reaches a preset value, movement of the images across the screen 28 stops and the operator of the toy then reads his score off the hit counters 44. By depression of the reset button 42, the elapsed playing time indicator and the hit counters are reset and a second series of play can be commenced. If, however, the operator of the toy 20 desires to discontinue play, the off/on handle 36 is pulled toward the handle 32 disrupting the electrical circuit and shutting the toy 20 off.

Located within the interior of the toy 20, positioned behind the screen 28, is a rotating drum 48. The drum 48 is formed as a cylindrical element having an open end 50. The cylindrical surface of the drum 48 is formed of a transparent material on which is overlayed an indicia strip 52. The indicia strip 52 forms a continuous scene around the circumferentially extending cylindrical surface of the drum 48. The indicia strip 52 includes certain target indicia 54 located thereon whose images serve as targets which the operator of the toy fires upon. On the other end of the drum 48 is a bottom cap 56 which includes a set of crown teeth 58 along its outer periphery. The bottom cap 56 has a central elongated bearing, not separately numbered or shown, which receives shaft 60 which partially supports the drum 48 on the bottom housing 22. The open end 50 of the drum 48 is further supported by three fingers collectively identified by the numeral 62, which are shown in phantom in both FIGS. 2 and 10. The fingers 62 support the bottom edge of the end 50 of the drum 48. One of the fingers fits within the interior of the drum and the other two on the exterior. The drum is free to rotate on the shaft 60 as hereinafter described.

The drum 48 has a hollow interior which is accessed via its open end 50. A lever arm 64 is mounted adjacent to the open end 50 of the drum 48. A second lever arm 66 is hinged to the lever arm 64 about hinge 68. The lever arm 66 is bent so as to include a 90° angle, and includes a bearing surface 70 formed thereon through which a shaft 60 passes. This supports the lever arm 66 within the interior of the drum 48, but still allows it to slide horizontally left and right along the length of the shaft 60 within the interior of the drum 48.

A lightbulb 72 is carried on the end of the lever arm 66. When the off/on handle 36 is positioned in the on position, the lightbulb 72 is energized whereby the light it emits passes through the transparent surface of the drum 48 and through the indicia strip 52 to project an image onto the backside of the screen 28. The screen 28 is formed of a translucent material such that the image is viewable through the front side of the screen 28 by the user of the toy 20.

The lever 64 is pivoted about pivot point 74 to the bottom housing 22. An arm 76 integrally joined to the lever arm 64 extends forward of the pivot point 74. The arm 76 is, in turn, hinged to an arm 78 which, in turn, is hinged to a further arm 80. The end of the arm 80, opposite where the arm 80 joins the arm 78, is hinged via an axle 82 to the bottom housing 22.

The arm 80, near where it joins the axle 82, includes a gear segment 84 located thereon. Gear segment 84 projects upwardly from the arm 80. The handle 32 attaches to a hollow shaft 86 which is horizontally supported on the bottom of the housing 22. The handle 32 is fixed to the shaft 86 such that as the handle 32 is rocked backward and forward in arc to the left and right, its motion is communicated to the shaft 86 rotating shaft 86. The shaft 86, on its forward end, carries gear segment 88 which meshes with the gear segment 84.

Figure 9:
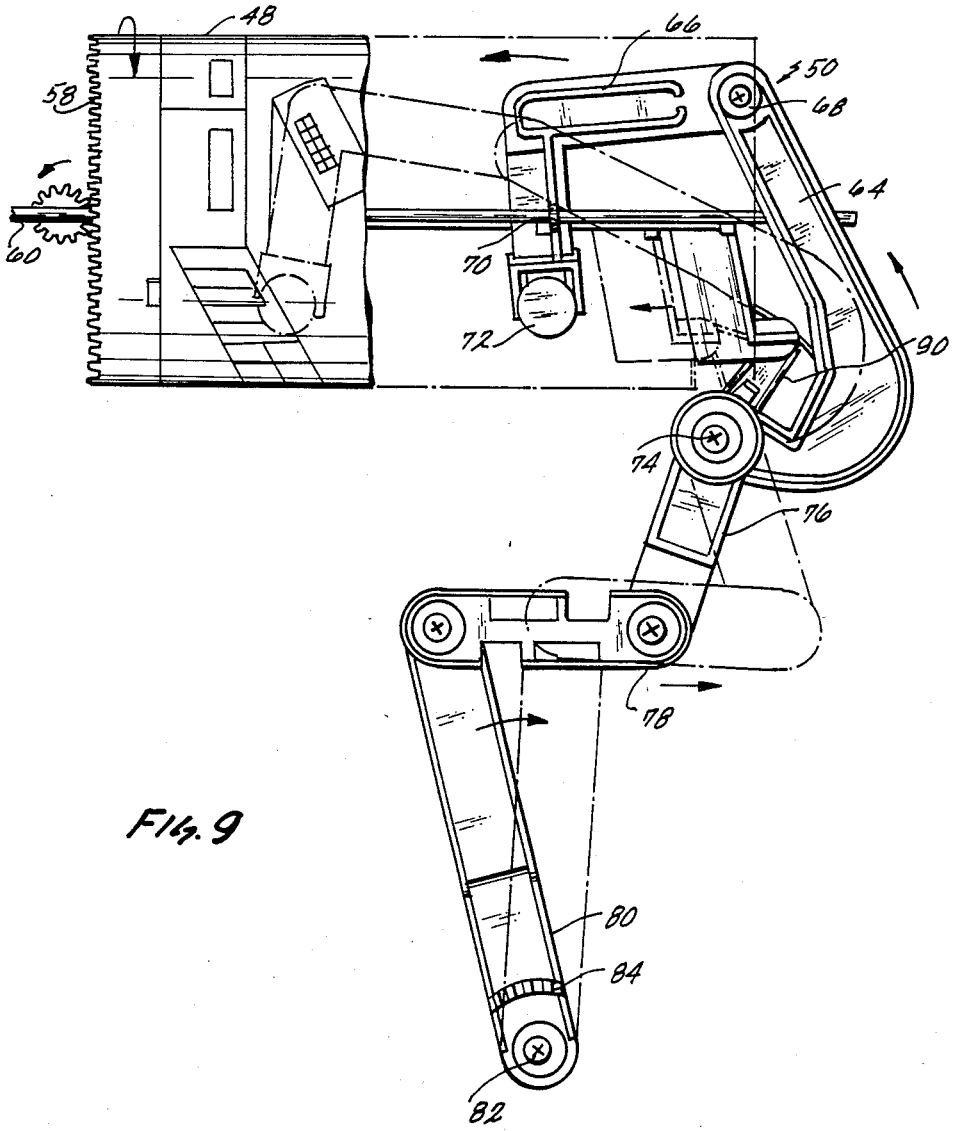
FIG. 9 is a plan view of certain other components generally lying near the right hand and back edges of FIG. 2.

In response to movement of the handle 32 to the left and right, its motion is communicated via shaft 86 and gear segment 88 to the arm 80 via gear segment 84. This moves the arm 80 about the axle 82 as is seen in solid and phantom lines in FIG. 9. This motion is transferred via arm 78 to arm 76 which, in turn, pivots the arm 64 about the pivot point 74 to move the arm 66, and the lightbulb 72 attached thereto, back and forth to the left and right within the interior of the drum 48. In response to the handle 32 being pushed to the left, the arm 80 pushes the arm 78 to the right which, in turn, transfers motion via the arm 76 and 64 to the arm 66 pushing it to the left. In response to the handle 32 being pushed to the right, the arm 66 and the lightbulb 72 also move to the right. Thus, because of the lever arrangement formed by the corresponding arms, the lightbulb 72 moves in the same direction as does the top of the handle 32 upon movement of the handle 32.

Since any indicia, such as target indicia 54 on the surface of the drum 48, is fixed with respect to left and right motion, when the lightbulb 72 moves beneath it, the image of the indicia projected onto the screen 28 moves in the opposite direction with respect to the movement of the lightbulb. However, the target area 30 is in a fixed position on the screen 28, and an illusion is created during play of the game such that the target area 30 follows the movement of the handle 32, that is, if the handle 32 is pushed to the left, the target area 30 moves to the left with respect to the pattern of indicia which is displayed on the screen 28 beneath it. During play of the toy 20, when the user of the toy is concentrating on the screen 28 and the target area 30, the target area 30 seems to move with respect to the moving scene on the screen 28 in response to the movement of the handle 32. Movement of the handle 32 to the left gives the impression of movement of the target area 30 to the left, and vice versa with respect to the right.

Aside from the horizontal movement back and forth of the indicia on the drum 48 as perceived on the screen 28, the drum 48 is also rotating. As viewed in FIG. 2, the top of the drum 48 rotates downwardly and forward toward the observer, that is, in a counterclockwise direction. This moves the indicia images which are projected onto the screen 28 from the top of the screen 28 toward the bottom of the screen 28 giving the illusion of the operator of the toy being in an aircraft or space type vehicle flying overhead of a scene which includes targets, such as the target indicia 54, which pass beneath it. The operator of the toy 20 attempts to fire at these target indicia 54 as they move downwardly across the screen 28. The indicia scene formed on the indicia strip 52 is such that as one indicia target 54 passes out of view at the bottom of the screen 28, another appears at the top of the screen 28. However, it may be shifted to the left or right of the one that just passed out of sight requiring the operator of the toy 22 to correct its horizontal position, with respect to the target area 30, by movement of the handle 32. Thus, the scene presented to the operator of the toy 20 is one of a continual movement both in an upward and downward direction along the screen 28 and in a left and right horizontal direction across the screen 28.

Figure 10:
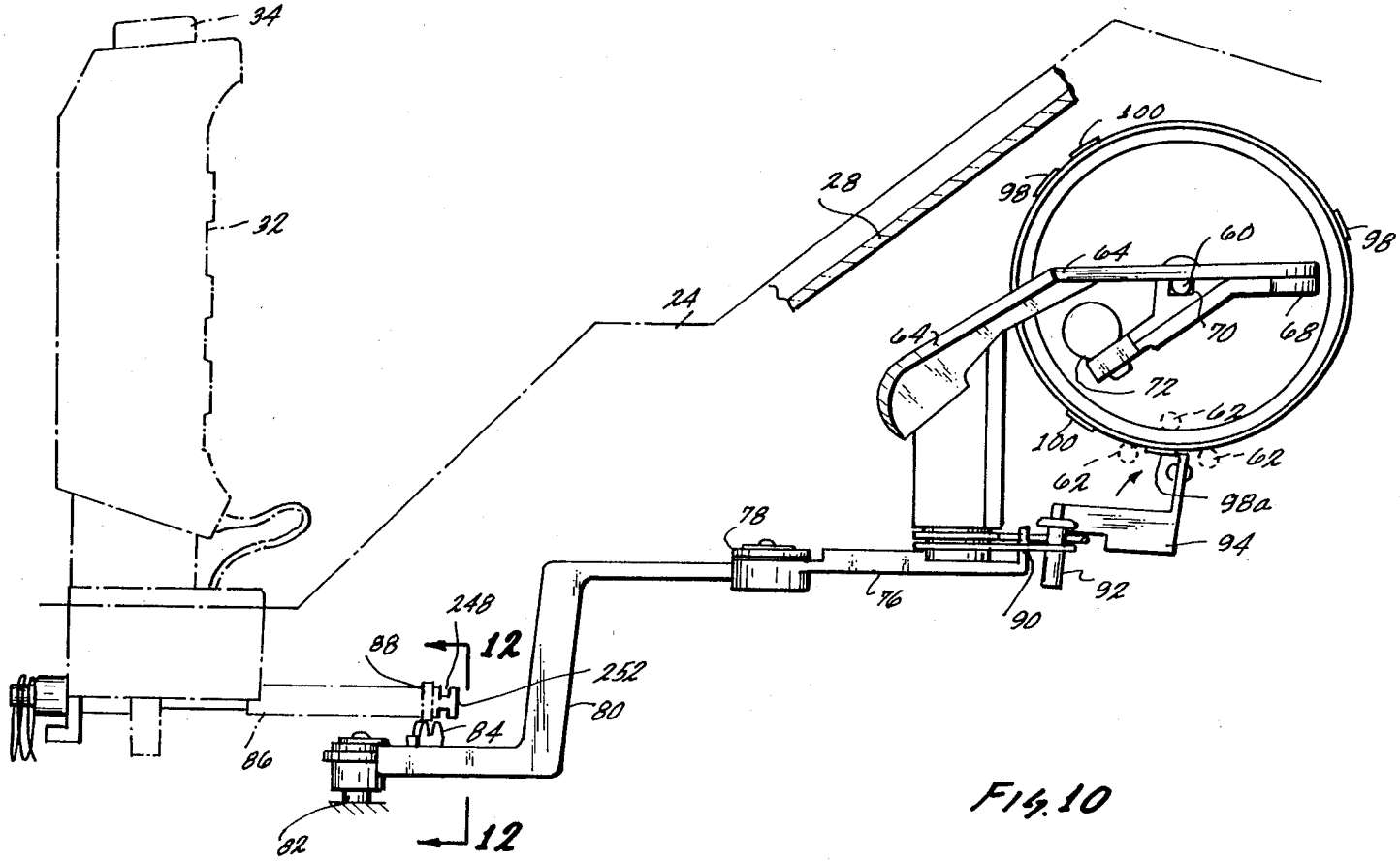
FIG. 10 is a side elevational view of the components of FIG. 9 with further components as seen in FIG. 1.

Extending from arm 76 on the opposite side of the pivot point 74, is a small spring arm 90. The spring arm 90 moves in conjunction with the arms 76 and 64 under the influence of the handle 32 as previously described. It is evident from FIG. 9 that the spring arm 90 is much shorter than the arm 64. It, however, moves in the same direction as the arm 64 since it is also attached to the arm 76. The spring arm 90 is formed as a loop having an open center. A boss 92, as is seen in FIG. 10, fits between the tines of the spring arm 90 so as to pivotally connect to the spring arm 90. The boss 92 is integrally formed as a portion of an L-shaped member 94. As seen in FIG. 13, the L-shaped member 94 fits between webs collectively identified by the numeral 96 which are formed on bottom housing 22. This allows member 94 to slide to the left and right, and also to rotate or tilt between the webs 96.

Located on both of the ends of the drum 48 are a plurality of projections, collectively identified by the numeral 98 along the end 50 of the drum 48, and the numeral 100 along the opposite end wherein the bottom cap 56 is located. The projections 98 and 100 are positioned circumferentially on the drum 48 so as to be related to one of the indicia targets 54 in a manner wherein when the indicia target 54 is positioned such that its images are projected onto the screen 28 and is horizontally located so as to be on the same horizontal plane as the target area 30, the particular projection, whether it be 98 or 100, which is associated with that indicia target 54, is positioned so as to extend directly downward from the bottom of the drum 48. One such projection, 98*a*, is seen in this position in FIG. 10. Thus, in FIG. 10, or projection 98, the target indicia 54 associated with it would be projected at that time onto the screen 28.

The member 94 includes a right side tab 102 and a left side tab 104 which form the highest points on the member 94. The member 94 is sized and shaped such that the projections 98 and 100 are capable of contacting the tabs 102 and 104 respectively if the side to side location of the member 94 is such that one of the tabs, 102 or 104, is located directly underneath the path of travel of projections 98 or 100. The group of projections 98 are circumferentially spaced around the surface of the drum 48 as well as being axially spaced with respect to the axis of the shaft 60 with respect to one another. Because the projections 98 are axially spaced with respect to one another they do not rotate in the same plane. The same is true with the projections 100. That is, they are individually circumferentially spaced with respect to one another, and also axially spaced with respect to one another. Because of this, in order for the projections, either 98 or 100, to contact either one of the tabs 102 or 104, the member 94 must be correctly positioned with respect to right and left movement to directly place its respective tab 102 or 104 in the line of travel of the respective projection 98 or 100.

Since the spring arm 90 contacts the boss 92 formed as a portion of the member 94, movement of the handle 32 is transferred to the member 94 to move it back and forth to the left and right underneath the drum 48. Thus, not only is the light 72 moving within the interior of the drum in response to movement of the handle 32, but the member 94 is also moving underneath the drum. The projections 98 and 100 are located axially on the drum 48 whereby in order for one of the projections 98 or 100 to engage with its respective tab 102 or 104, the target image 54 which is in association with the particular projection, must be centered within the target area 30 on the screen 28. If it is not centered with respect to horizontal movement, the projection 98 or 100 will not engage the respective tab 102 or 104.

When one of the projections 98 or 100 does engage the tabs 102 or 104, corresponding to placement of the particular indicia image 54 within the target area 30, engagement of the respective projection against the respective tab tilts the member 94 to the right as seen in FIG. 10. This motions, or tilting of the member 94, is communicated to a further member as hereinafter discussed.

Since the boss 92 is free to move upwardly and downwardly between the tines of the spring arm 90, the member 94 is always engaged with the spring arm 90. However, it is free to be tilted upon engagement between the projections 98 and 100 and the tabs 102 and 104.

The arm 64 and the spring arm 90, in effect, are levers having their fulcrum at pivot point 74. Since the spring arm 90 is a much shorter lever than the arm 64, the mechanical advantage of the arm 64 is greater and this greater mechanical advantage, when transferred to movement of the lightbulb 72, results in a greater movement of the lightbulb 72 to the left and right than the left and right movement of the member 94 which attaches to the smaller lever spring arm 90. This allows for a large lateral movement of the images 54 on the screen 28 to be accompanied by a smaller but proportional movement of the member 94 which is reflective of horizontal positioning of the indicia images 54 within the target area 30. Because of this, very accurate axial positioning of the particular projections 98 or 100, with respect to the tabs 102 and 104, can be sensed without having to resort to a large lateral travel of the member 94.

As seen in FIG. 13, a bell crank 106 is positioned to the left and behind the member 94. The bell crank 106 pivots about an axle 108. The short arm 110 of the bell crank 106 has a small tab 112 located thereon. A transfer arm 114 is also pivoted mounted on the axle 108. The transfer arm rests on top of the short arm 110. The transfer arm also includes a small tab 116. A spring 118 is connected between the tabs 112 and 116 so as to connect the transfer arm 114 to the short arm 110 of the bell crank 106. When the member 94 is tilted it contacts the transfer arm 114 pushing it backward. This motion is transferred via the spring 118 to the bell crank 106 to rotate the bell crank 106 around its axle 108. Whenever one of the projections 98 or 100 contact the respective tabs 102 or 104, this movement is communicated to the bell crank 106 to rotate it about its axle 108. This serves as a first control input to a control mechanism for the toy 20 as discussed below. This first control input is governed by the left and right positioning of the target indicia 54 with respect to the target area 30 under the influence of the handle 32.

Figure 2:
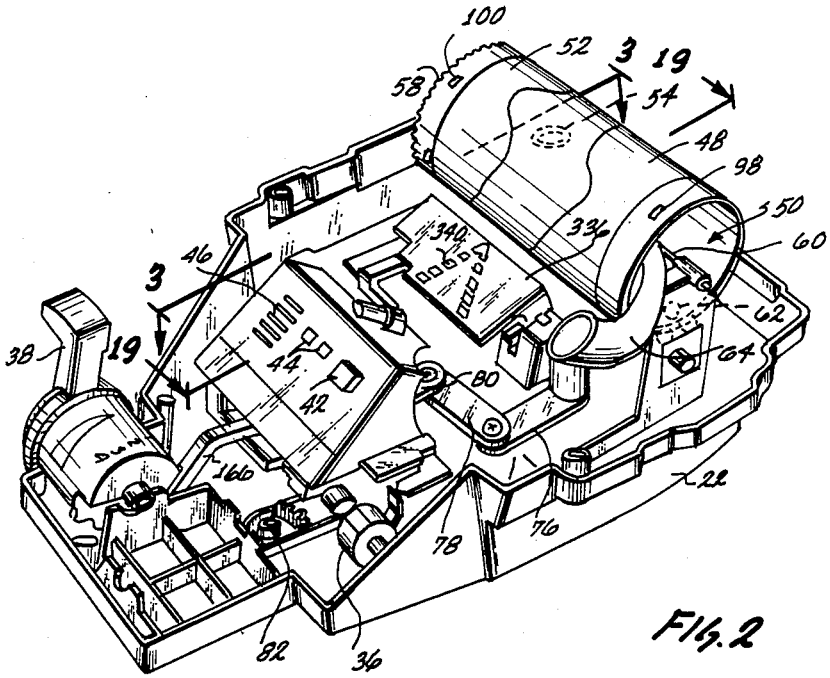
FIG. 2 is a further isometric view rotated 90° from the view of FIG. 1, and different from FIG. 1 in that certain overlying components have been removed to better show underlying components.

A motor 120 is located within the toy in the area shown in FIG. 2 beneath the drum 48. To the left of the motor 120 are appropriate batteries 122 shown schematically in FIG. 18. The off/on handle 36 controls a switch 124, shown schematically in FIG. 18. When the toy 20 is turned on, the switch 124 is closed and the motor 120 is activated as is the lightbulb 72, also shown schematically in FIG. 18. A further circuit component, as hereinafter described, is also included in FIG. 18.

Figure 4:
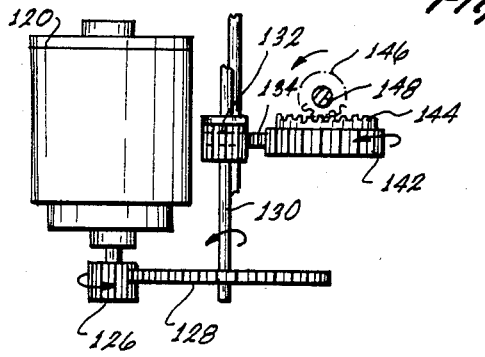
FIG. 4 is an elevational view about the line 4—4 of FIG. 3.

The output pinion 126 of the motor 120 drives a large spur gear 128 which in turn rotates an axle 130 on which it is mounted. The axle 130 also carries a pinion 132 fixedly mounted thereon. The pinion 132 is positioned so as to be capable of being engaged with a spur gear 134 mounted on an axle 136. As seen in FIG. 19, also mounted around the axle 136 is a spring 138 which can be compressed between the spur gear 134 and a boss 140 which serves as a bearing surface for the spring 138. The spring 138 tends to bias the spur gear 134 upwardly so that it engages both pinion 132 and a further spur gear 142 positioned behind it in FIG. 19, and to the side of it in FIG. 4. The axle 136, and the spur gear 134 attached thereto, are free to move upwardly and downwardly in a very limited amount of travel to control a function of the toy 20 as hereinafter explained. For the purposes of further describing the gear train, the spur gear 134 will be described as in the position in FIG. 4 wherein it completes a gear train between pinion 132 and the spur gear 142.

Integrally formed on top of the spur gear 142 are crown teeth 144. These mesh with a pinion 146 which is fixed to an axle 148. Fixed to one end of the axle 148 is an elongated pinion 150, and at the other end of the axle 148 a further pinion 152. The elongated pinion 150 ultimately transfers motion to the drum 48. The pinion 152 ultimately transfers motion to the control mechanism associated with fire button 34, hit button 44, and the elapsed playing indicator 46.

Figure 7:
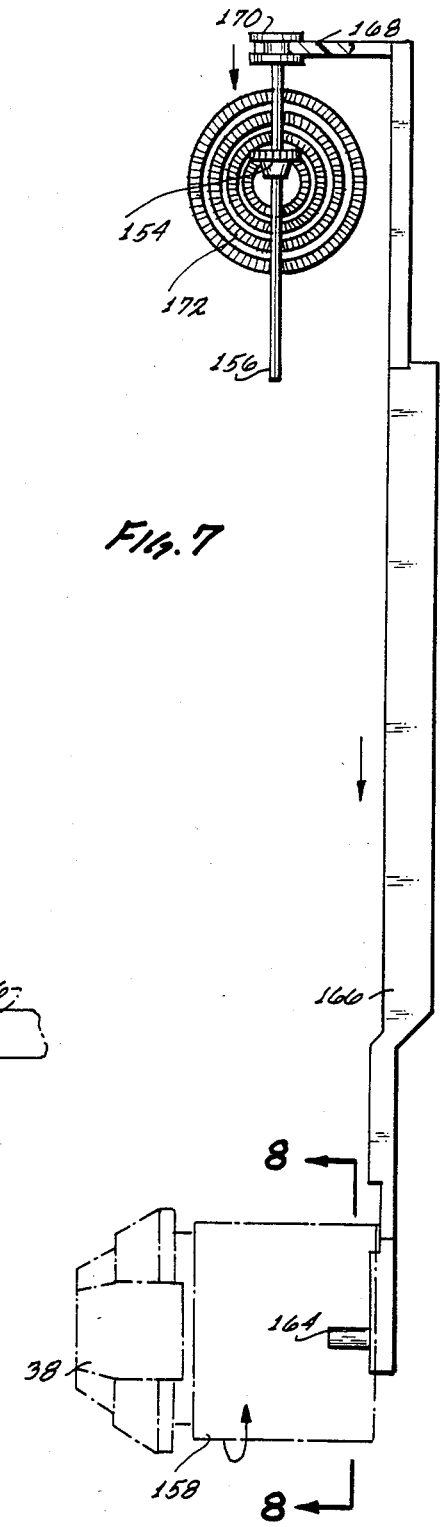
FIG. 7 is a plan view of certain other components seen in FIG. 3, as well as further components best seen in FIG. 2.
Figure 8:
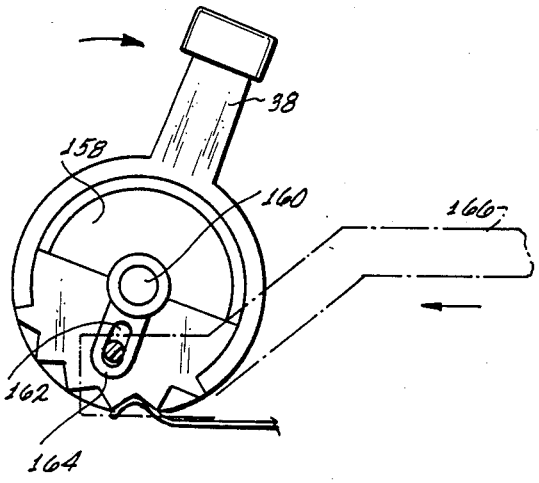
FIG. 8 is a plan view about the line 8—8 of FIG. 7.

Positioned adjacent to the elongated pinion 150 is a small spur gear 154. The spur gear 154 is mounted on an elongated shaft 156 which is free to slide up and down as viewed in FIGS. 3 and 7 in response to positioning of the speed shift handle 38. As is viewable in FIGS. 7 and 8, the speed shift handle 38 is connected to a rotary member 158 which is rotatably mounted about an axle 160 to the bottom housing 22. The member 158 includes a slot 162 which is engaged by a small pin 164 formed as a portion of a shift transfer member 166. As seen in FIG. 8, when the speed shift handle 38 is pushed forward or pulled backward, this motion is communicated to the shift transfer member 166 to slide it backward and forward along the longitudinal axis of the toy 20.

On the end of the shift transfer member 166, opposite the pin 164, is a small fork 168. The fork 168 engages a sheave 170 which is also attached to the shaft 156. The sheave 170 is free to turn within the tines of the fork 168, but, in response to movement of the shift transfer member 166 along the longitudinal axis of the toy 20, the motion of the member 166 is transferred via the sheave 170 to the shaft 156 to move it, and the spur gear 154 attached thereto, backward and forward along the longitudinal axis of the toy 20.

A shifting gear 172, having four sets of crown teeth, cocentricately located on its upper surface, is positioned directly below the spur gear 154. Depending upon the position of the speed shift handle 38, the gear 154 will engage either one of the four sets of crown teeth on the shifting gear 172, corresponding to the four speeds of the toy 20; or the gear 154 will be located so that it is no longer positioned over the shifting gear 176 and, thus, does not engage any of the crown teeth on the shifting gear 172 corresponding to the neutral position of the speed shifting handle 38.

Figure 3:
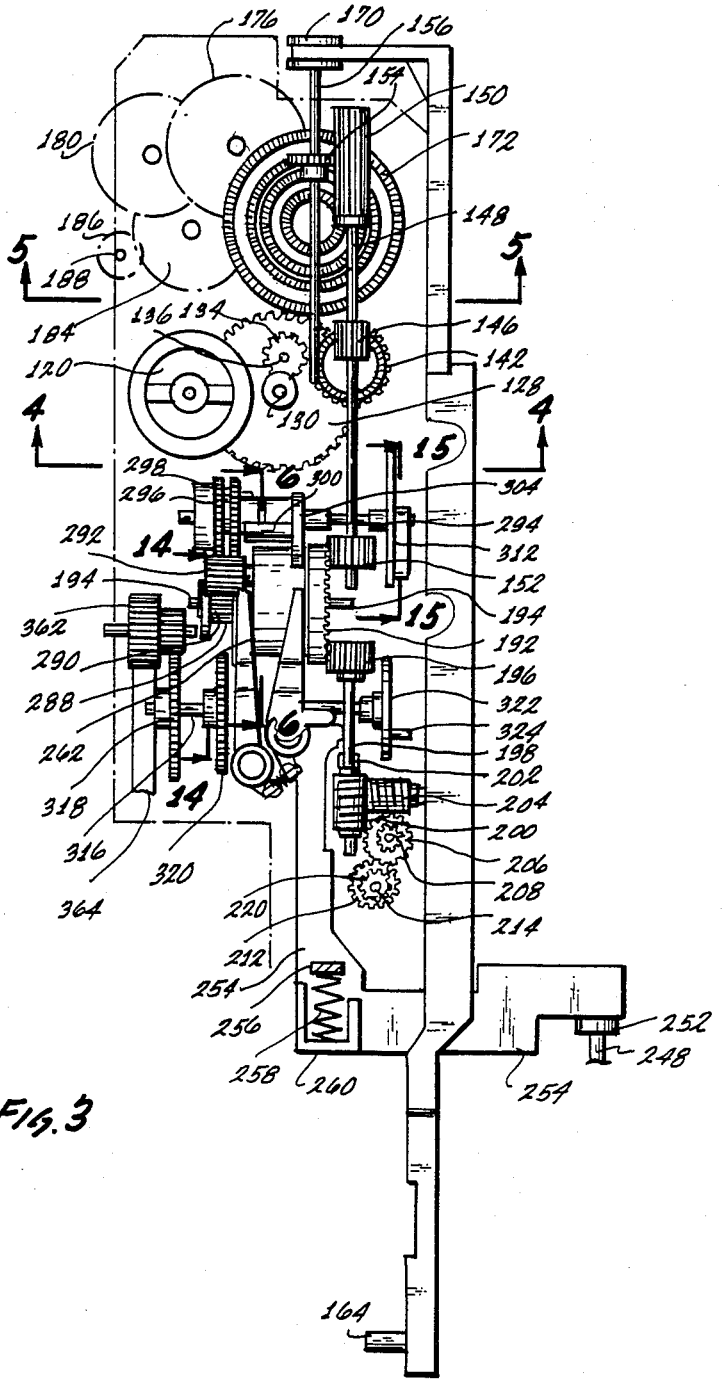
FIG. 3 is a top plan view about the line 3—3 of FIG. 2.
Figure 5:
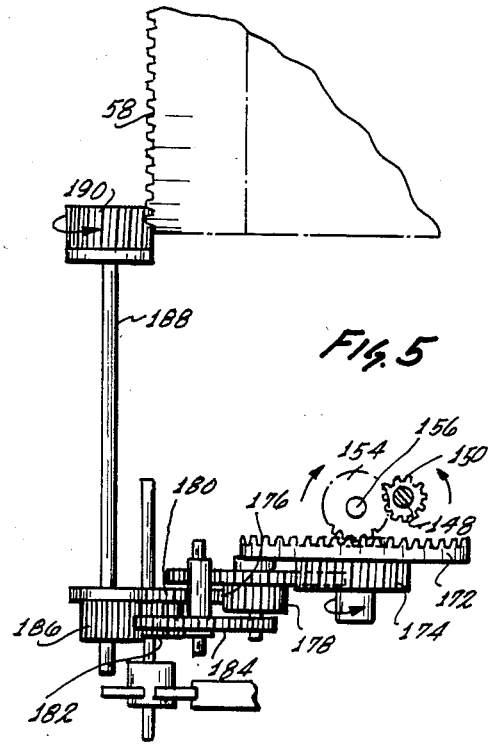
FIG. 5 is an elevational view about the line 5—5 of FIG. 3.

Referring now to FIGS. 3 and 5, located on the underside of the shifting gear 172 is a pinion 174. Pionion 174 is integrally formed with the shifting gear 172 so as to rotate with it. A spur gear 176 meshes with the pinion 174. The spur gear 176 carries a pinion 178 on its underneath side which meshes with a further spur gear 180. The spur gear 180, in turn, carries a pinion 182 on its underneath side which meshes with a spur gear 184. The spur gear 184 meshes with a pinion 186 formed on the bottom of a long shaft 188. On the upper end of the shaft 188 is a pinion 190 which meshes with the crown teeth 58 on the bottom cap 56 of the drum 48. As such, rotation of the motor 120 is communicated to the drum 48 via the gear train leading to the elongated pinion 150 and from there through the shifting gear 172 to the pinion 186, and ultimately through the shaft 188 to the pinion 190. Depending upon the position of the speed shift handle 38, the drum will either not rotate or will rotate in one of four forward speeds.

The pinion 152, which is also rotated by the motor 120, meshes with a crown gear 192 which is fixed to a shaft 194. The crown gear 192 further meshes with a pinion 196. The pinion 196 is mounted to a shaft 198 which also includes a worm gear 200 fixed to it. The worm gear 200 engages a spur gear 202 which is integrally formed with a worm gear 204. The worm gear 204 engages a spur gear 206 integrally formed with a pinion 208.

Positioned adjacent to the pinion 208 and the spur gear 206 is a spur gear 212. The spur gear 212 is fixed to a shaft 214. The shaft 214 is journalled within a housing plate 216 such that it can slide up and down under the influence of a spring 218 which is positioned between the housing plate 216 and a pinion 220 also, located on the shaft 214. The pinion 208 is elongated such that the spur gear 212 is in constant mesh with it irrespective of the up and down position of the shaft 214.

A sliding member 222 slides on the upper surface of the housing plate 216. The sliding member 222 has a gear rack not shown in FIG. 19 which engages the pinion 220. Thus, rotation of the pinion 220 is transferred to the sliding member 222 to move it to the left as seen in FIG. 19 during operation of the toy 20. If the shaft 214 and the pinion 220 attached thereto are depressed downwardly compressing the spring 218, the pinion 220 is released from the gear rack which is formed on sliding member 222, allowing the sliding member 222 to be slid to the right under the influence of a spring 224 which connects between it and the housing plate 216.

As the toy 20 operates, the sliding member 222, seen in FIG. 19, is slid slowly to the left. Located on the underside of the sliding member 222 is a wedge 226. The wedge is positioned such that when the member 222 is slid to its furthest limit of travel to the left, the wedge 226 engages the top of the axle 136 and pushes it downward. This disengages the spur gear 134 from the pinion 132 severing rotation transmitted by the motor 120 to the two gear trains which are ultimately rotated by rotation of the shaft 148. This serves as a timing mechanism for the length of time of operation of the toy 20 between each reset, under the control of the reset button 42.

When the reset button 42 is depressed, it actuates an arm 228 located on the side of the counter housing 230 seen in FIG. 19. Normally, the arm 228 is biased counterclockwise by the spring 232. When the reset button 42 is pressed inwardly toward the counter housing 230, the end of the arm 228 engages the top of the shaft 214, depressing it, and the pinion gear 220 attached thereto, downwardly. This releases the pinion gear 220 from the gear rack formed on the sliding member 222, allowing the sliding member 222 to be slid to the right under the influence of the spring 224 to reset the timing mechanism. Thus, reset of the timing mechanism is accomplished by depression of the shaft 214, and termination of the timing cycle is accomplished by depression of the axle 136.

The sliding member 222 also serves to control the elapsed playing time indicator 46. The elapsed playing time indicator 46 is formed as a sliding member located on the back of the face plate of the counter housing 230. The counter housing 230 has a plurality of slits which allows for a colored surface on the elapsed playing time indicator 46 to be exposed. On the back of the elapsed playing time indicator 46 is a gear rack 234. This gear rack 234 engages with a pinion 236 which further engages with a gear rack 238 formed on the upper surface of the sliding member 222. As such, the elapsed playing time indicator 46 slides along the front face plate of the counter housing 230 in response to horizontal sliding of the sliding member 222.

Figure 11:
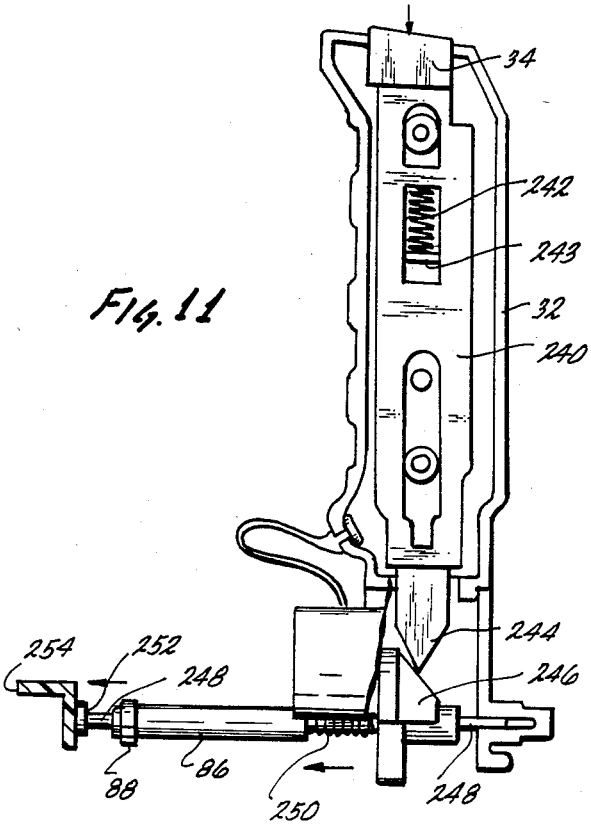
FIG. 11 is a side elevational view in section of the left hand most component of FIG. 10.
Figure 12:
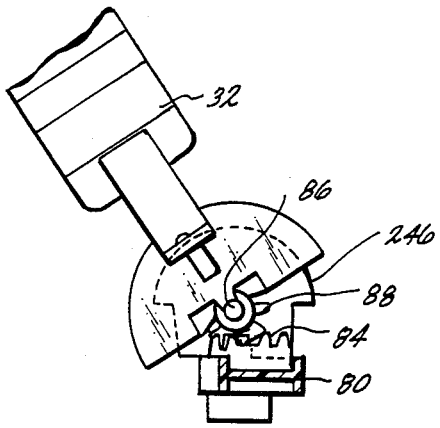
FIG. 12 is an elevational view about the line 12—12 of FIG. 10.

As seen in FIG. 11, the handle 32 is hollow. It includes an internal sliding member 240. The sliding member 240 is biased upwardly by a compression spring 242, fitting inbetween it and a web 243 formed on the internal surface of the handle 32. On the bottom of the sliding member 240 is a point 244. It is positioned so as to engage an arcuate shaped sector 246.

The sector 246 has a wedge shape along its total surface. It is attached to a shaft 248 which is coaxial with, and is located within the interior of, hollow shaft 86. A spring 250 is mounted around the shaft 248 and biases the wedge 246 backwardly toward the operator of the toy. The shaft 248 extends out of the front end of the shaft 86, forward of the gear sector 88. Each time the fire button 34 is depressed, it depresses the sliding member 240 downwardly which, in turn, communicates via the point 244 to move the wedge 246 and the shaft 248 forward. Utimately, this moves the end 252 of the shaft forward upon each depression of the fire button 34. The spring 242 biases the member 240, and the fire button attached thereto, upwardly, and the spring 250 biases the shaft 248 backwardly, such that each time the fire button 34 is released, the shaft 248 is withdrawn back toward the right in FIG. 11.

The end 252 of shaft 248 bumps against a sliding member 254, which is seen in plan view FIG. 3, with a portion of it seen in FIG. 11 the showing interaction of it with the shaft 248. Each time the fire button 34 is depressed, the sliding member 254 is slid upward as viewed in FIG. 3. The sliding member 254 is located beneath housing plate 216. The housing plate 216 includes a small web 256 which projects downwardly. A compression spring 258 fits between the web 256 and a U-shaped baffle 260 formed on the upper surface of sliding member 254. When the fire button 34 is depressd, the movement transmitted to the sliding member 254 compresses the compression spring 258 between the web 256 and the baffle 260. When the fire button 34 is released, the tension created within the spring 258 moves the sliding member 254 downwardly as viewed in FIG. 3 in conjunction with the return movement of the shaft 248 to the right as seen in FIG. 11, and the upward movement of the fire button 34 also seen in FIG. 11.

In reference to FIGS. 3 and 13, positioned directly to the left of crown gear 192 is cylindrical control member 262. The cylindrical control member 262 is rotatably mounted on the shaft 194. However, while the crown gear 192 is fixed to the shaft 194 and rotates in conjunction with it, the control member 262 is freely mounted onto the shaft 194 and can rotate independent of rotation of the shaft or the crown gear 192. A small spring not seen in the drawings is located between the control member 262 and the crown gear 192 about the shaft 194. This spring provides a frictional engagement between the crown gear 192 and the control member 262 such that the control member 262 tends to rotate in in conjunction with rotation of the crown gear 192, if, in fact, nothing impedes rotation of the control member 262. If, in fact, anything does impede rotation of the control member 262, the spring slips with respect to one or the other of the crown gear 192 or the control member 262 such that rotation of the crown gear 192 is not transferred to the control member 262.

Figure 6:
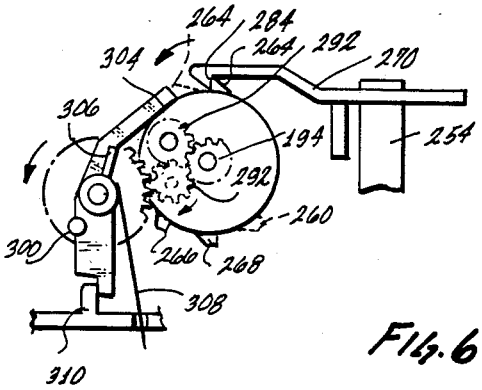
FIG. 6 is an elevational view about the line 6—6 of FIG. 3.

The control member 262 is formed as a cylinder having a cylindrical surface of revolution. Located on this cylindrical surface of revolution, as is seen in FIGS. 6 and 14, are three detents 264, 266, and 268, which serve as points of interaction between other control or linking components.

A first linking element formed as control arm 270 is rotatably mounted about a boss 272 formed on the bottom housing 22. Positioned next to it is a second control arm 274. It is rotatably mounted about a boss 276. A small spring 278 connects between one of the ends of both arms 270 and 274 such that, as seen in FIGS. 3 and 13, the uppermost ends of the arms 270 and 274 are biased away from each other, and the ends of the arms 270 and 274, which have the spring 278 located thereon, are biased toward each other.

The arm 270 is formed as a small bell crank and has a side arm 280. The slide member 254 is positioned next to the side arm 280. Each time the fire button 34 is depressed, movement communicated to the sliding member 254 is transferred to the side arm 280 to rotate the control arm 270 counterclockwise about its boss 272.

As previously noted, upon tilting of the member 94, motion is communicated to the bell crank 106 to rotate it counterclockwise such that its long arm 282, which is positioned adjacent to the control arm 274, contacts the arm 274 to rotate the arm 274 clockwise as seen in FIGS. 3 and 13. If the arm 270 is rotated counterclockwise, or if the arm 274 is rotated clockwise, this biases the spring 278 tending to restore one of both of the arms to what can be considered as their initial position, as is seen in FIG. 3.

The detent 264 is positioned on the right hand edge of the surface of revolution of the control member 262 as viewed in FIGS. 3 and 13. The detent 266 is positioned in about the center of the surface of revolution of the control member 262; and the detent 268 is positioned near the left hand edge of the surface of revolution of the control member 262. As such, the detents 264, 266, and 268 are axially displaced with respect to one another along the axis of shaft 194, and are circumferentially spaced with respect to one another around the surface of revolution of the control member 262.

The control arm 270 has a small tooth 284 located on its end. This is shown in FIG. 6. The tooth 284 is capable of interacting with detents 264 and 266 depending on the position of the control arm 270. If the control arm is positioned as seen in FIG. 3, the tooth 284 is positioned so it can act with the left side detent 264. When the slide member 254 is slid upwardly upon depression of the fire button 34, the tooth 284, on the end of arm 270, is swung over the center of the control member 262 positioning the tooth 284 where it can engage the detent 266. There is a similar tooth, tooth 286, on the arm 274. When the arm 274 is positioned as seen in FIG. 3, the tooth 286 is not located over the surface of revolution of the control member 262 and, thus, is out of position to interact with any of the detents. When the member 94 is tilted, however, contact of the long arm 282 of the bell crank 106 against the arm 274, rotates the arm 274 over the surface of the control member 262 in the position as seen in FIG. 13 wherein the tooth 286 can engage the detent 268.

A sun gear 288 is fixedly mounted to shaft 294 next to the control member 262. Also attached to the shaft 294, next to the sun gear 288, is a bushing 290. A planetary gear 292 is journalled to the right hand side of the control member 262, as seen in FIG. 3. The bushing 290 holds the planetary gear 292 in its bearing surface on the control member 262. The planetary gear 292 meshes with the sun gear 288. As the shaft 194 is rotated in response to the rotation of the crown gear 192, the rotation of the shaft 194 rotates the sun gear 288 which, in turn, rotates the planetary gear 292.

A shaft 294 is located parallel to the shaft 194. The shaft 294 includes two gears, gears 296 and 298, which are positioned on its left hand side as seen in FIG. 3 in a position wherein they are capable of being contacted by the planetary gear 292. The gear 296 is freely mounted on the shaft 294 and can rotate independently of it. A small spring arm of standard design, not numbered or shown, which is located directly beneath the gear 296, in FIG. 3, engages the gear 296 and emits a clicking noise upon rotation of the gear 296.

The gear 298 includes a small peg 300 which is located on its right hand side as seen in FIG. 3, and is shown in section in FIG. 6. Located next to the gear 298 on shaft 294 is a bushing 302. The bushing 302 is integrally formed with further control arm 304. An extension 306 of the control arm 304 projects in the pathway of travel of the peg 300 on the gear 298. A hairpin spring 308 is attached about the control arm 304 to bias the control arm 304 clockwise as viewed in FIG. 6. A small web 310, formed on bottom housing 22 limits the clockwise rotation of the control arm 304. The spring 308 biases the bottom of the control arm 304 against the web 310 and this, in turn, positions the top of control arm 304 next to the left hand side of the control member 262. When the gear 298 is rotated, as hereinafter described, the peg 300 on the gear 298, engages the extension 306 on the control arm 304, to rotate the control arm counterclockwise tensing the spring 308. When the force rotating the gear 298 is removed, the tension imparted to the spring 308 returns the control arm clockwise, as seen in FIG. 6, to the position shown in FIG. 6.

Attached to the right hand end of the shaft 294 as seen in FIG. 3, is a disk 312 having an eccentricately positioned, arcuately shaped, web 314 located on its right hand face as seen in FIG. 3. In response to rotation of the gear 298, the shaft 294 rotates the disk 312 which, in turn, moves the web 314. This movement is communicated to further components as hereinafter described.

A further shaft, shaft 316, is also parallel to the shaft 194. It is seen below the shaft 194 in FIG. 3. The shaft 316 includes two gears and a disk fixed to it, and, as such, they all rotate in unison. The first gear, gear 318, is located on the left hand end of shaft 316 as viewed in FIG. 3. Placed just to the left of arm 274 is spur gear 320 which is positioned within the path of travel of the planetary gear 292. Located on the right hand end of shaft 316, as seen in FIG. 3, is disk 322. Disk 322 includes a crank pin 324 located on its surface.

At an initial or rest position, the arm 270 is positioned over the control member 262 near its left hand edge. Rotation of the crown gear 192 is transferred to the control member 262, rotating it counterclockwise, as seen in FIGS. 6 or 14, such that the detent 264 engages the tooth 284. This positions the planetary gear 292 in the position shown in FIG. 6. When the fire button 34 is depressed, its motion is ultimately communicated to sliding member 254 which, in turn, rotates the arm 270 counterclockwise, as seen in FIG. 3, sliding the tooth 284 off of the left hand side of the detent 264, freeing it. This allows the control member 262 to rotate to the position shown in phantom line in FIG. 6, wherein the detent 264 becomes locked against the control arm 304. When in this position, the planetary gear 292 engages the two gears 296 and 298, rotating them counterclockwise as seen in FIG. 6. This causes the gear 296 to rotate against the unseen arm emitting a clicking noise, while at the same time causes the gear 298 to rotate counterclockwise slowly until such time as its peg 300 engages the extension 306. Upon engagement of the peg 300 against the extension 306, the arm 304 is rotated counterclockwise until its end is lifted up free of the detent 264 allowing the control member 262 to rotate clockwise. Upon this clockwise rotation, the planetary gear 292 is rotated out of engagement with the gears 296 and 298, and the tension induced into the hair pin spring 308 rotates the control arm 304 clockwise until it is once again resting next to the surface of the control member 262.

The depression of the fire button 34, in freeing the tooth from the detent 264, positions the tooth 284 such that its is in the locus of travel of the detent 266. If nothing impedes full rotation of the control member 262, as hereinafter explained, eventually the control member 262 will rotate until the detent 266 engages the tooth 284 which positions the planetary gear 292 in the position shown in phantom lines in FIG. 14, such that it is not engaged with any further gears. When the fire button 34 is released, ultimately the control arm 270 moves back to the position shown in FIG. 3, releasing from its engagement with the detent 266, and allowing the control member 262 to rotate until once again the detent 264 engages the tooth 284 to reposition the control member in the initial or starting position.

Figure 16:
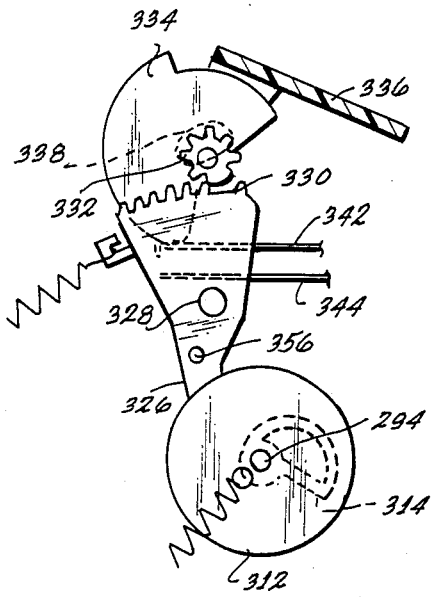
FIG. 16 is a side elevational view in partial section of certain other components which are hidden from view in FIG. 2, but which are located essentially in the center of the mechanism as seen in FIG. 2.
Figure 17:
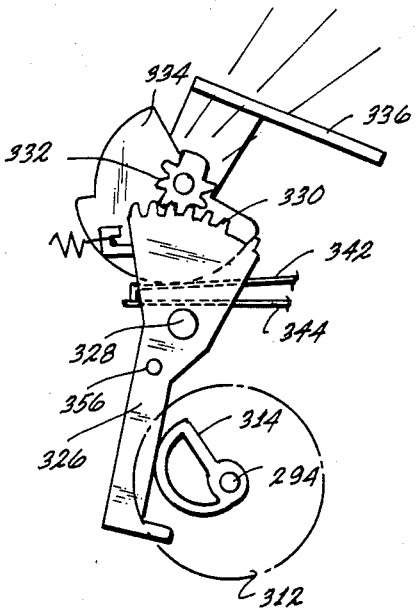
FIG. 17 is a view similar to FIG. 16 except certain other components are seen in a different spacial configuration.

Aside from moving the control arm 304, rotation of the gear 298, when the planetary gear 292 is engaged with it, is also transmitted by the shaft 294 to the disk 312. An arm 326, pivoted about axle 328 on the top of housing plate 216, is positioned in the pathway of the web 314. The upper end of the arm 326 includes a gear sector 330 which is in mesh with a pinion 332 which is integrally formed with a housing 334. The housing 334 is appropriately journalled on top of housing plate 216 beneath a further plate 336 which is seen in FIGS. 2, 16, and 17. An LED 338, shown schematically in FIG. 18, and in phantom lines in FIGS. 16 and 17, is located within the interior of the housing 334. The housing 334 is shaped as a portion of a cylinder with one side removed. When the housing 334 is positioned as seen in FIG. 16, the LED is shielded. When it is rotated as seen in FIG. 17, and the LED is concurrently energized, the light emitted from the LED passes through holes collectively identified by the numeral 340 located in plate 336, and strikes the screen 28.

Each time the shaft 294 is rotated, under the influence of the planetary gear 292, the gear section 330 rotates the pinion 332 which, in turn, rotates the housing 334 to expose the LED 338. Rotation of the housing 334 also presses an electrical contact 342 against a further contact 344 which are shown schematically in FIG. 18, and mechanically in FIGS. 16 and 17. This closes the circuit to the LED 338 causing the same to emit light to flash the pattern of the holes 340 onto the screen 28. This happens each and every time the fire button 34 is depressed.

When the fire button 34 is depressed, as noted above, the tooth 284 releases from the detent 264, allowing the control member 262 to rotate. This rotation is initially stopped when the detent 264 engages the arm 304. However, upon release of the arm 304 from the detent 264, the rotation continues. If, at this time, the member 94 is tilted by correctly positioning one of the indicia images 54 within the target area 30, the motion is transmitted to the arm 274 to move it from the position seen in FIG. 3 to that seen in FIG. 13. This positions it in the locus of travel of the detent 268 such that it becomes engaged with the tooth 286 of the arm 274 as shown in FIG. 14. This positions the planetary gear 292 in engagement with the gear 320.

The spur gear 320 has a skirt 366 on its side next to arm 274. The skirt includes a cut out area 368. The arm 274 has a small extension 370 which projects downwardly next to the skirt 366. When the cut out area 368 is located next to the projection 370, the arm 274 can swing to the left as in FIG. 3. When the tooth 286 on the arm 274 engages the detent 268 and the gear 320, and the skirt 366 attached thereto, are rotated, the cut out area 368 rotates away from the projection 370 and it becomes locked against the skirt 366, holding the detent 268 against the tooth 286 irrespective of further movement of the bell crank 106 and member 94. Only after a full revolution of gear 320, does cut out area 368 once again become positioned adjacent to projection 370, allowing arm 274 to move from the position in FIG. 13 to the position in FIG. 3. This maintains the engagement of planetary gear 292 with spur gear 320 for a full rotation of the spur gear 320 maintaining the control member 262 in an intermediate position for the increment of time necessary for gear 320 to complete its rotation.

In conjunction with rotation of gear 320, shaft 316 and disk 322 are rotated. The crank pin 324 on disk 322 is positioned within a forked extension 346 on a sliding member 348. The sliding member 348 includes a gear rack 350 which engages a pinion 352, formed as a part of the plate member 336. Rotation of disk 322 is transferred to member 348 to slide member 348. This, in turn, rotates the plate member 336, and concurrently a lower arm 354 on the member 348 abuts against a peg 356, formed on the arm 326, to rotate the housing 334 and to flash the LED 338.

As opposed to the above noted simple flashing of the LED 338 when the fire button 34 is depressed, if the target indicia 54 is also located within the target area 30 upon concurrent pressing of the fire button 34, then the LED 338 is flashed in conjunction with movement of the plate 336, and light is not only exposed through the openings 340 in the plate 336, but as the plate 336 moves to the position shown in the phantom configuration in FIG. 15, light is directly emitted from the area noted by the arrow 359 so as to be exposed in a somewhat burst like pattern onto the screen 28 to indicate a hit on the target indicia 54 located within the target area 30.

Additionally, upon movement of the sliding member 348, movement is communicated to the hit counters 44. A fork 358, formed on member 348, interacts with an arm 360 which is attached to the counter wheel mechanism to increment the counter wheels. The counter wheel mechanism utilizes a ratchet mechanism which is standard and, as such, is not described in detail.

The gear 318, which is also rotated when the shaft 316 is rotated, engages a gear 362 which is formed with a small and large pinion. The large pinion engages a flexible arm 364 which emits a further noise as the teeth of the gear 362 are pulled across its surface. Thus, not only is there a visual indication of a "hit", but a sound is emitted concurrent with the flashing of the LED 338.

I claim:

1. A toy which comprises:

a housing;

a hollow drum means rotatably mounted on said housing;

motor means located on said housing in operative association with said drum means, said motor means rotating said drum means on said housing;

at least a portion of the surface of said drum means transparent to the passage of light through said drum means;

at least one indicia means located on said transparent portion of said surface of said drum means;

screen means located on said housing in association with said drum means;

at least one contct means located on said drum means, said contact means located in association with said indicia means;

a moving means located on said housing in operative association with said drum means, a first portion of said moving means located within the interior of said drum means, a second portion of said moving means located in association with said contact means so as to be able to interact with said contact means, a further portion of said moving means located on said housing in a position so as to be capable of being acted on by an operator of said toy;

said first and said second portions of said moving means operatively connected to said further portions of said moving means so as to move on said housing in response to action on said further portion by an operator of said toy;

a light source means positioned on said first portion of said moving means within the interior of said drum means, said light source means moving in conjunction with movement of said first portion of said moving means, said light source means emitting light within the interior of said drum means, said light passing through said transparent portions of said surface of said drum means and projecting an image of said indicia means on said screen means, said image of said indicia means moving on said screen in response to both rotation of said drum means on said housing and to movement of said moving means;

output means located on said housing in operative association with said second portion of said moving means, said output means for indicating concurrent interaction of said contact means with said second portion of said moving means and projection of said image of said indicia means on said screen.

2. The toy of claim 1 wherein:

said image of said indicia moves on said screen in one of a vertical or horizontal direction in response to rotation of said drum means, and in the other said vertical or horizontal direction in response to movement of said light source and said first portion of said moving means.

3. The toy of claim 1 wherein:

said contact means comprises at least one projection means located on said drum means, said projection means rotating in response to rotation of said drum means;

said projection means interacting with said second portion of said moving means during a portion of a revolution of said drum means.

4. The toy of claim 3 wherein:

said second portion of said moving means moves along a first axis between a contact position and a non-contact position in response to movement imparted to said second portion of said moving means by said further portion of said moving means;

said second portion of said moving means moving along a second axis when simultaneously it is in said contact position and said projection means interacts with said second portion of said moving means.

5. The toy of claim 1 wherein:

said first portion of said moving means comprising a first lever;

said second portion of said moving means comprising a second lever means;

both said first and said second lever means connected to said further portion of said moving means so as to be moved in response to movement of said further portion of said moving means;

said light source means attaching to said first lever means and moving in response to movement of said first lever means, said first and said second lever means having different mechanical advantages whereby the magnitude motion of said light means is different from the magnitude of motion of said second lever means.

6. The toy of claim 1 wherein:

said screen means includes a target area fixedly located thereon;

said image of said indicia means moving with respect to said target area in response to both rotation of said drum means and movement of said first portion of said moving means;

trigger means located on said housing in a position so as to be activated on by the operator of said toy, said trigger means operatively associated with said output means, said output means for indicating concurrent activation of said trigger means and interaction of said contact means with said second portion of said moving means.

7. The toy of claim 6 wherein:

said output means includes a control means and further includes an output indicator;

said control means sensing the concurrent interaction of said second portion of said moving means with said contact means and activation of said trigger means;

said output indicator operatively associated with said control means so as to produce a sensory output in response to said control means sensing said concurrent interaction of said second portion of said moving means with said contact means and activation of said trigger means.

8. A toy which comprises:

a housing;

a event indicator means, said event indicator means for indicating an event to a user of said toy;

a user activation means located on said housing, at least a portion of said user activation means located on said housing in a position so as to be activated on by a user of said toy;

a first linking means movably mounted on said housing, said first linking means operatively associated with said user activation means, said first linking means moving between a first position and a second position and back to said first position in response to activation of said user activation means;

a second linking means movably mounted on said housing, said second linking means operatively associated with said event indicator means, said second linking means movable between a first position and a second position, said second linking means moving from said first position to said second position in response to indication of said event, said second linking means moving from said second position back to said first position in response to said event no longer being indicated;

a control means located on said housing, said control means including a first interaction means and a second interaction means, said control means moving on said housing from an initial position to an intermediate position and back to said initial position, said first linking means operatively associated with said first interaction means whereby when said first linking means is in its respective first position said control means is held in its initial position and when said first linking means moves from its first position to its second position said control means moves from its initial position to at least its intermediate position;

said second linking means operatively associated with said second interaction means whereby if said second linking means is in its second position when said control means moves from its initial position to its intermediate position said second linking means interacts with said second interaction means to temporarily hold said control means in its intermediate position and when said second linking means is in its first position when said control means moves from its first position to its intermediate position said second linking means does not interact with said second interaction means and said control means moves from its intermediate position to its first position.

9. The toy of claim 8 wherein:

said control means includes a control member movably located on said housing, said control member including a control surface located thereon, said first and said second interaction means located on said control surface, and positioned on said control surface so as to interact with said first and said second linking means.

10. The toy of claim 9 wherein:

said control member is rotatably mounted on said housing;

said control surface comprises a continuous surface of revolution located on a control member;

said first and said second member interaction means comprise detents located on said surface of revolution, said detents circumferentially spaced with respect to one another on said surface of revolution.

11. The toy of claim 8 wherein:

said first linking means includes a first control arm located in association with said control means so as to mechanically interact with said first interaction means;

said second linking means includes a second control arm located in association with said control means so as to mechanically interact with said second linking means.

12. The toy of claim 10 wherein:

said first linking means includes a first control arm located in association with said control means so as to mechanically interact with said first interaction means;

said second linking means includes a second control arm located in association with said control means so as to mechanically interact with said second linking means.

13. The toy of claim 8 further including:

timing means associated with said control means, said timing means controlling the rate of change of said control means between its first position, its intermediate position, and back to its first position.

14. The toy of claim 11 including:

timing means, said timing means associated with said control means, said timing means including a delay means and a third control arm;

said third control arm associated with said control member and positioned with respect to said control member so as to interact with said first interaction means;

said delay means operatively connected to said third control arm whereas when said third control arm interacts with said second interaction means said delay means increments a unit of time and upon completion of said increment unit of time said delay means severs the interaction between said third control arm and said second interaction means.

15. The toy of claim 8 wherein:

said event indicator means includes a hollow drum means rotatably mounted on said housing;

a driving means located on said housing in operative associated with said drum means, said driving means rotating said drum means on said housing;

at least a portion of said surface of said drum means transparent to the passage of light through said drum means;

at least one indicia means located on said transparent portion of said surface of said drum means;

screen means located on said housing in association with said drum means;

light source means positioned within the interior of said drum means, said light source means emitting light within the interior of said drum means, said light passing through said transparent portion of said surface of said drum means and projecting an image of said indicia means on said screen means, said image of said indicia means moving on said screen means in response to rotation of said drum means.

16. The toy of claim 14 wherein:

said user activation means includes a moving means, said moving means movably located on said housing, at least a portion of said moving means located within the interior of said drum means, said light emitting means mounted on said portion of said moving means located within the interior of said drum means, a further portion of said moving means located on said housing in a position so as to be acted on by the user of said toy, said light emitting means moving within the interior of said drum means in response to activation of said further portion of said moving means by the user of said toy;

movement of said light emitting means within the interior of said drum means causing said image of said indicia means to move on said screen in a first direction and rotation of said drum means on said housing causing said image of said indicia means to move on said screen in a second direction.

17. A toy which comprises:

a housing;

a control drum rotatably mounted in said housing, said control drum having a surface of revolution, said control drum including a first and second detent located on said surface of revolution, said first and said second detents axially displaced with respect to the axis of rotation of said control drum;

a first control arm located in association with said control drum and positioned with respect to said control drum so as to be able to interact with said first detent;

a first user input means, said first user input means operatively associated with said first control arm, wherein said first control arm moves with respect to said control drum in response to operator interaction on said first operator interaction means;

a second control arm located in association with said control drum, said second control arm positioned with respect to said control drum so as to be able to interact with said second detent on said control drum;

a second operator interaction means, said second operator interaction means operatively associated with said second control arm such that said second control arm moves with respect to said control drum in response to interaction of a user of said toy with said second operator interaction means.

18. The toy of claim 17 further including:

a third control arm, said third control arm positioned on said housing in association with said control drum, said third control arm located on said housing in operative association with said control drum, said third control arm positioned with respect to said control drum so as to be in a position to interact with said first detent on said control drum.

19. The toy of claim 18 including:

a gear located on said control drum so as to rotate on said control drum;

a first output gear train located in association with said control drum and said gear on said control drum;

a second output gear train located in association with said control drum and said output gear on said control drum;

said gear on said control drum meshing with said first gear train when said first control arm interacts with said first detent on said control drum and said gear on said control drum meshing with said second output gear train when said second control arm interacts with said second detent on said control drum;

said gear not meshing with either of said first or said second gear trains when said first detent on said control drum interacts with said third control arm.

* * * * *

UNITED STATES PATENT AND TRADEMARK OFFICE

CERTIFICATE OF CORRECTION

PATENT NO. : 4,602,790

DATED : JULY 29, 1986

INVENTOR(S) : MASAMI FURUKAWA

It is certified that error appears in the above-identified patent and that said Letters Patent is hereby corrected as shown below:

Column 5, line 8, "and" should be --are--.

Column 8, line 22, "motions" should be --motion--.

Column 8, line 52, "pivoted" should be --pivotally--.

Column 9, line 37, "hit button 44" should be --counters 44--.

Column 9, line 64, "cocentricately" should be --concentrically--.

Column 11, line 56, the word "the" should be deleted.

Column 12, line 18, the second occurrence of the word "in" should be deleted.

Column 12, line 55, the first occurrence of the word "of" should be --or--.

UNITED STATES PATENT AND TRADEMARK OFFICE

CERTIFICATE OF CORRECTION

PATENT NO. : 4,602,790

DATED : JULY 29, 1986

INVENTOR(S) : MASAMI FURUKAWA

It is certified that error appears in the above-identified patent and that said Letters Patent is hereby corrected as shown below:

Column 14, line 44, after the first occurrence of the word "tooth" insert the numeral --284--.

Column 17, line 49, after the word "magnitude" insert the word --of--.

Column 19, line 56, the word "associated" should be --association--.

Signed and Sealed this

Third Day of February, 1987

*Attest:*

*Attesting Officer*

DONALD J. QUIGG

*Commissioner of Patents and Trademarks*